US007261074B2

(12) United States Patent
Kim et al.

(10) Patent No.: US 7,261,074 B2
(45) Date of Patent: Aug. 28, 2007

(54) CONTINUOUSLY VARIABLE VALVE LIFT SYSTEM FOR ENGINES

(75) Inventors: Dae-Sung Kim, Hwaseong-si (KR); Woo-Tae Kim, Hwaseong-si (KR); Ju-Yeol Park, Hwaseong-si (KR); Back-Sik Kim, Hwaseong-si (KR); In-Gee Suh, Hwaseong-si (KR); Dong-Hee Han, Seoul (KR); Seung-Yeon Yang, Ansan-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/299,374

(22) Filed: Dec. 8, 2005

(65) Prior Publication Data

US 2007/0107681 A1 May 17, 2007

(30) Foreign Application Priority Data

Nov. 15, 2005 (KR) ..... 10-2005-0109123

(51) Int. Cl.
*F01L 1/34* (2006.01)

(52) U.S. Cl. ..... 123/90.16; 123/90.15; 123/90.41

(58) Field of Classification Search ..... 123/90.16, 123/90.15, 90.31, 90.2, 90.41
See application file for complete search history.

(56) References Cited

U.S. PATENT DOCUMENTS 5,025,761 A * 6/1991 Chen ..... 123/90.16
6,955,146 B2 * 10/2005 Werler ..... 123/90.16

* cited by examiner

*Primary Examiner*—Zelalem Eshete
(74) *Attorney, Agent, or Firm*—Morgan Lewis & Bockius LLP

(57) ABSTRACT

Disclosed herein is a continuously variable valve lift system for an engine which is able to variably adjust valve lift and opening duration of intake and exhaust valves operated by the rotation of a cam shaft. The continuously variable valve lift system of the present invention has a compact structure, so that space required for the system in a cylinder head is reduced. Furthermore, the continuously variable valve lift system is provided at a position level with or below a position at which the cam shaft is installed, thus reducing the overall height of the cylinder head, thereby reducing the volume of the engine.

7 Claims, 10 Drawing Sheets

CONTINUOUSLY VARIABLE VALVE LIFT SYSTEM FOR ENGINES

CROSS-REFERENCE TO RELATED APPLICATIONS

The present application is based on, and claims priority from, Korean Application Serial Number 10-2005-0109123, filed on Nov. 15, 2005, the disclosure of which is hereby incorporated by reference herein in its entirety.

FIELD OF THE INVENTION

The present invention relates to continuously variable valve lift systems for engines and, more particularly, to a continuously variable valve lift system for engines which is able to variably control opening and shutting times and periods of intake and exhaust valves operated by the rotation of a cam shaft.

BACKGROUND OF THE INVENTION

As well known to those skilled in the art, it is impossible to vary valve lift or opening duration using typical cams provided in conventional engine systems. Furthermore, because the valve lift and opening duration are fixed as specific values, a fuel consumption ratio and power output of an engine cannot be optimized.

In an effort to overcome the problems experienced with the conventional arts, recently, studies have been conduced on variation of opening and shutting times and periods of intake and exhaust valves in order to increase thermal efficiency and power output of engines. As part of these studies, a continuously variable valve lift system has been proposed.

In detail, the continuously variable valve lift system is able to adjust opening and shutting times of intake and exhaust valves and factors such as valve lift, related to valve movement, such that they are optimized. For example, the system maximizes the inflow rate of the engine in a high-speed or high-loading condition that requires high output power. In a low-speed or low-loading condition in which it is important to increase a fuel consumption ratio or reduce exhaust gas, the system increases an EGR (exhaust gas recirculation) effect and minimizes throttle loss.

However, in the conventional continuously variable valve lift system, structures of moving parts are complex. Furthermore, because the system requires a large space above a position at which a cam shaft is mounted in the cylinder head of the engine, the overall height of the cylinder head is increased.

As a result, the volume of an engine having the conventional continuously variable valve lift system is increased. As well, due to an increase in space required for the cylinder head in an engine room, there is a spatial restriction in the installation of other elements in the engine room.

SUMMARY OF THE INVENTION

Embodiments of the present invention provide a continuously variable valve lift system for an engine which is able to variably adjust valve lift and opening duration of intake and exhaust valves operated by the rotation of a cam shaft despite having a compact structure, so that the space required for the system in a cylinder head is reduced, and which is provided at a position level with or below the position at which the cam shaft is installed, thus reducing the overall height of the cylinder head, thereby reducing the volume of the engine.

A continuously variable valve lift system according to an embodiment of the present invention includes a cam shaft which is provided in a cylinder head of an engine and rotated in conjunction with a crank shaft, with a plurality of cams provided on the cam shaft to open and shut intake and exhaust valves. A rotary adjuster is set such that a rotating angle thereof is variably adjusted depending on an operational condition of the engine, with first contact parts provided at predetermined positions on the rotary adjuster and having predetermined curvatures. Bearing members are compressed both by the cams and by the first contact parts of the rotary adjuster, such that moving tracks of the bearing members vary dependently with the cams and the first contact parts. Elastic members bring the bearing members into contact with the cams and the rotary adjuster. Rocker arms are in contact with and compressed by the bearing members and have second contact parts having predetermined curvatures. Each of the rocker arms is pivotably supported at a first end thereof by a lash adjuster and compresses at a second end thereof each of the intake and exhaust valves. The rotary adjuster is set such that a rotation center thereof is a level with or is lower than a rotation center of the cam shaft based on a lower surface of the cylinder head. The bearing members are disposed below the cam shaft and between the rotary adjuster and the rocker arms.

The rotary adjuster may include a rotating shaft set such that a rotating angle thereof is adjusted by a step motor. A plurality of control cams may be provided at predetermined positions on the rotating shaft and oriented downwards. Each of the control cams may have the first contact part having the predetermined curvature. A rotating angle of the step motor may be adjusted by an electronic control unit (ECU) depending on a load of the vehicle when traveling.

Each of the bearing members may include a support shaft disposed along a longitudinal center line of the bearing member. First contact rings may be rotatably fitted at predetermined positions over a circumferential outer surface of the support shaft, such that each of the first contact rings contacts each of the first contact parts of the rotary adjuster. Second contact rings may be rotatably fitted over the circumferential outer surface of the support shaft at positions close to inner sidewalls of the first contact rings, such that each of the second contact rings contacts each of the second contact parts of the rocker arms. A third contact ring may be rotatably fitted over the circumferential outer surface of the support shaft at a position close to inner sidewalls of the second contact rings and contact the associated cam.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Figure 1:
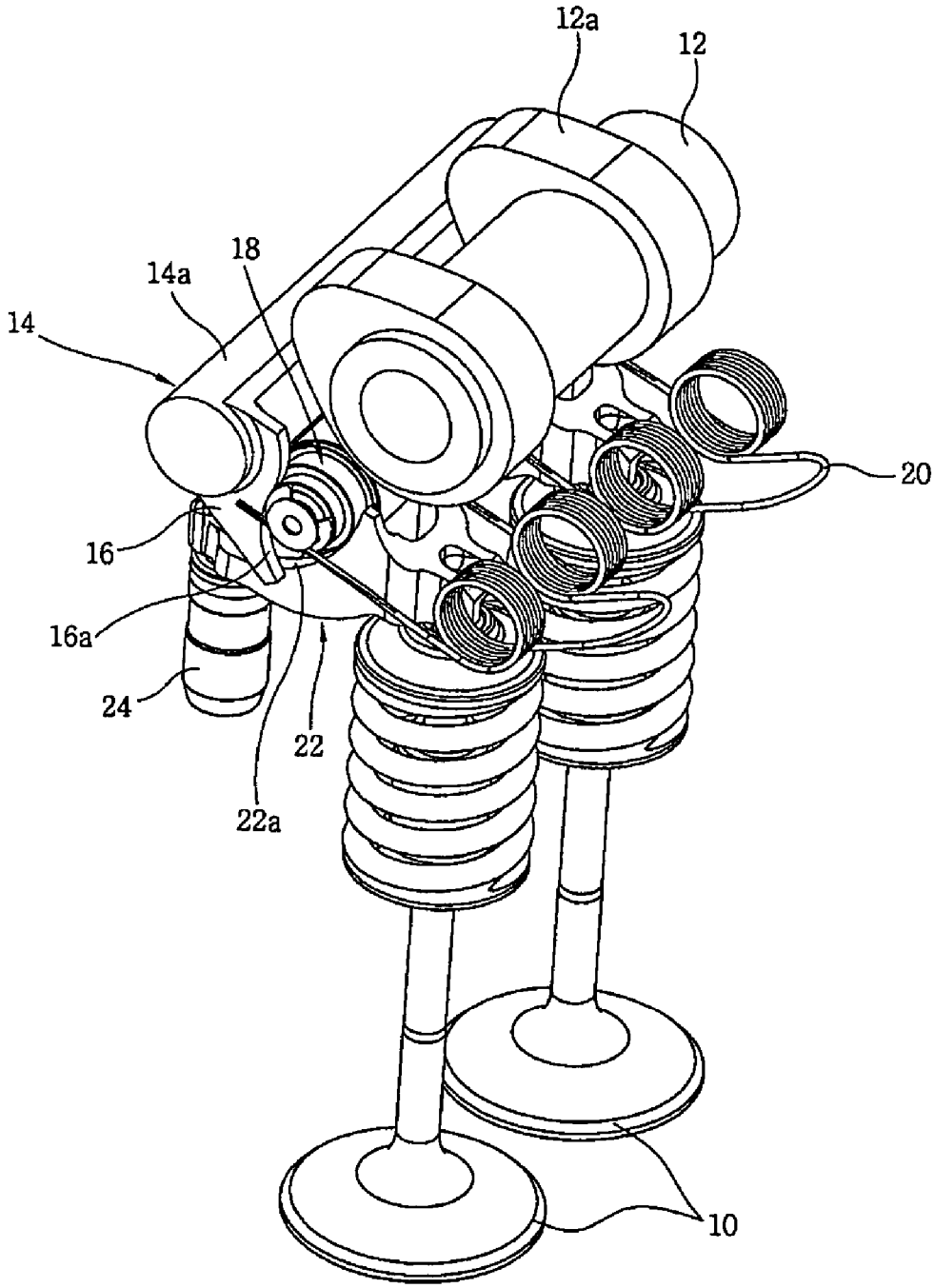
FIG. 1 is a perspective view of a continuously variable valve lift system for engines, according to an embodiment of the present invention.
Figure 2:
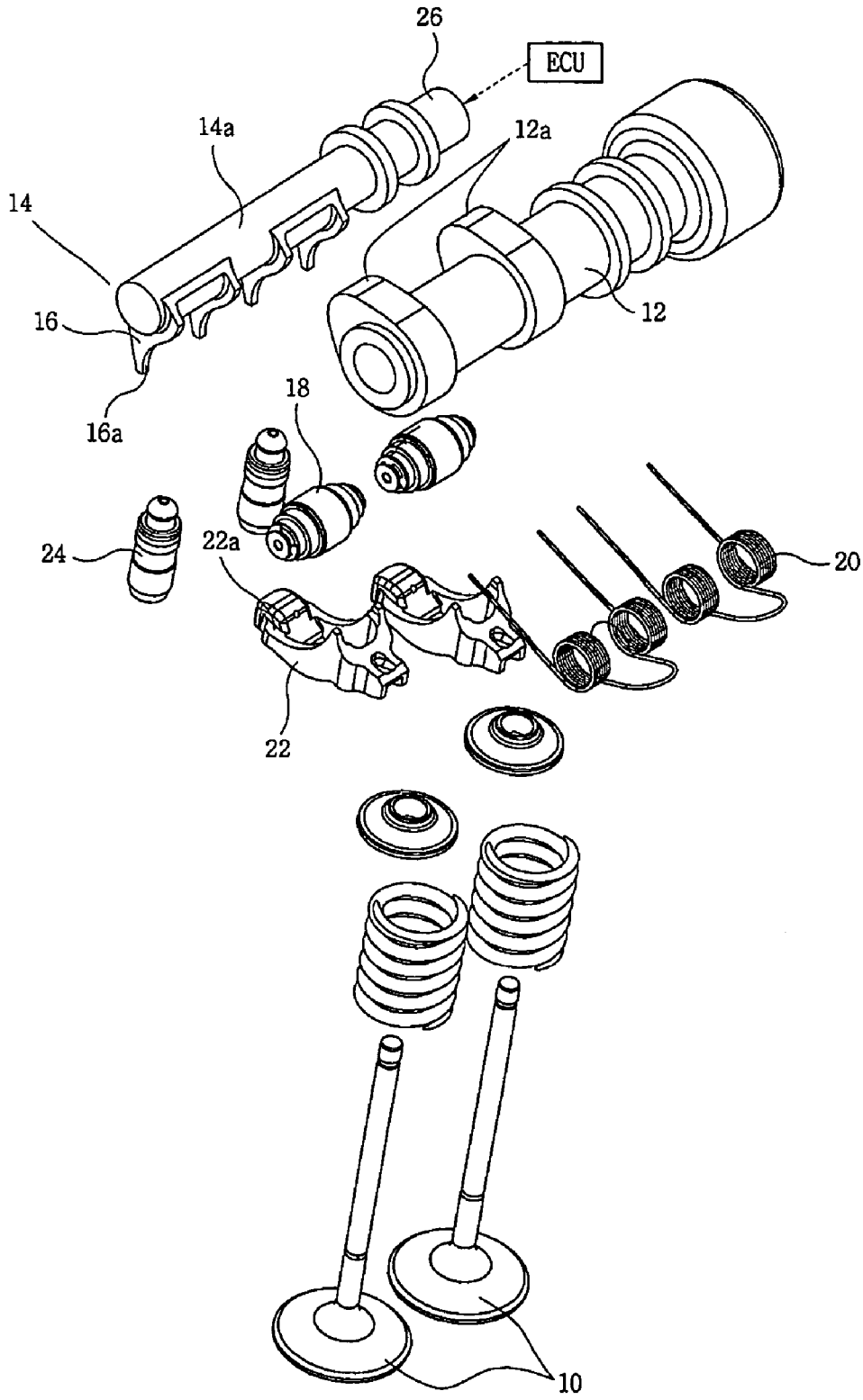
FIG. 2 is an exploded perspective view of the continuously variable valve lift system of FIG. 1.
Figure 3:
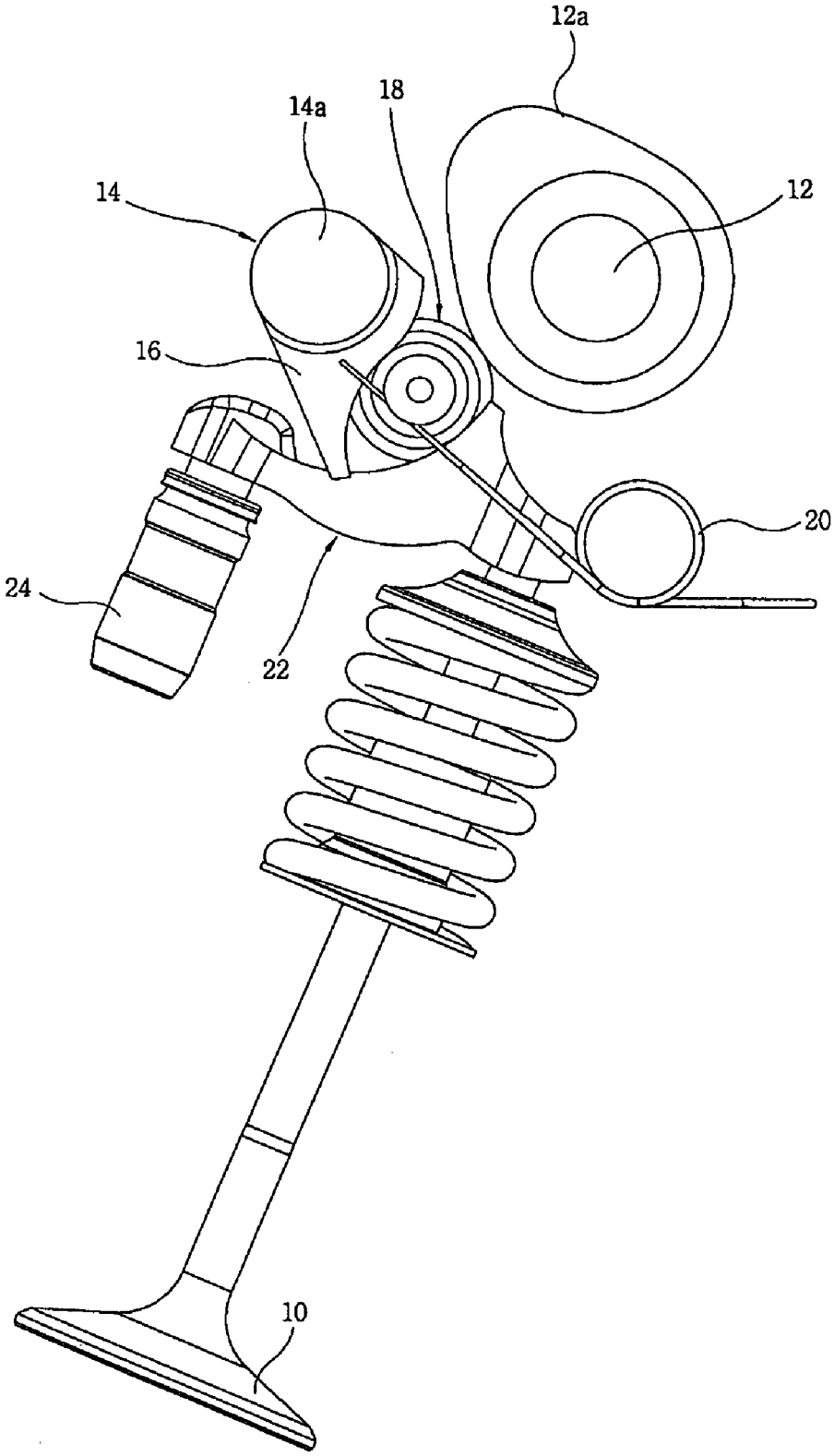
FIGS. 3 and 4 respectively are front and sectional views of the continuously variable valve lift system according to the present invention.
Figure 4:
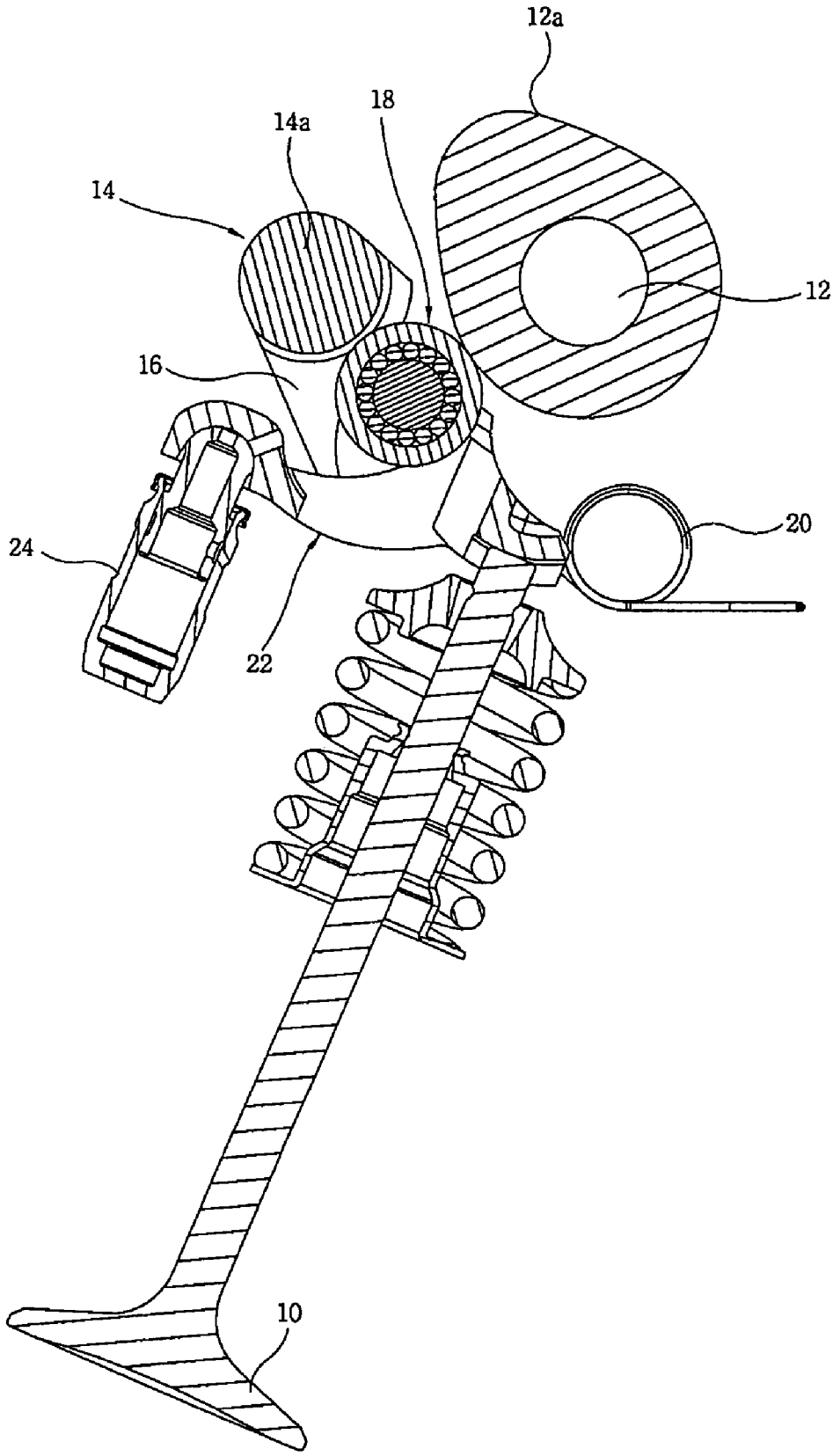
Figure 5:
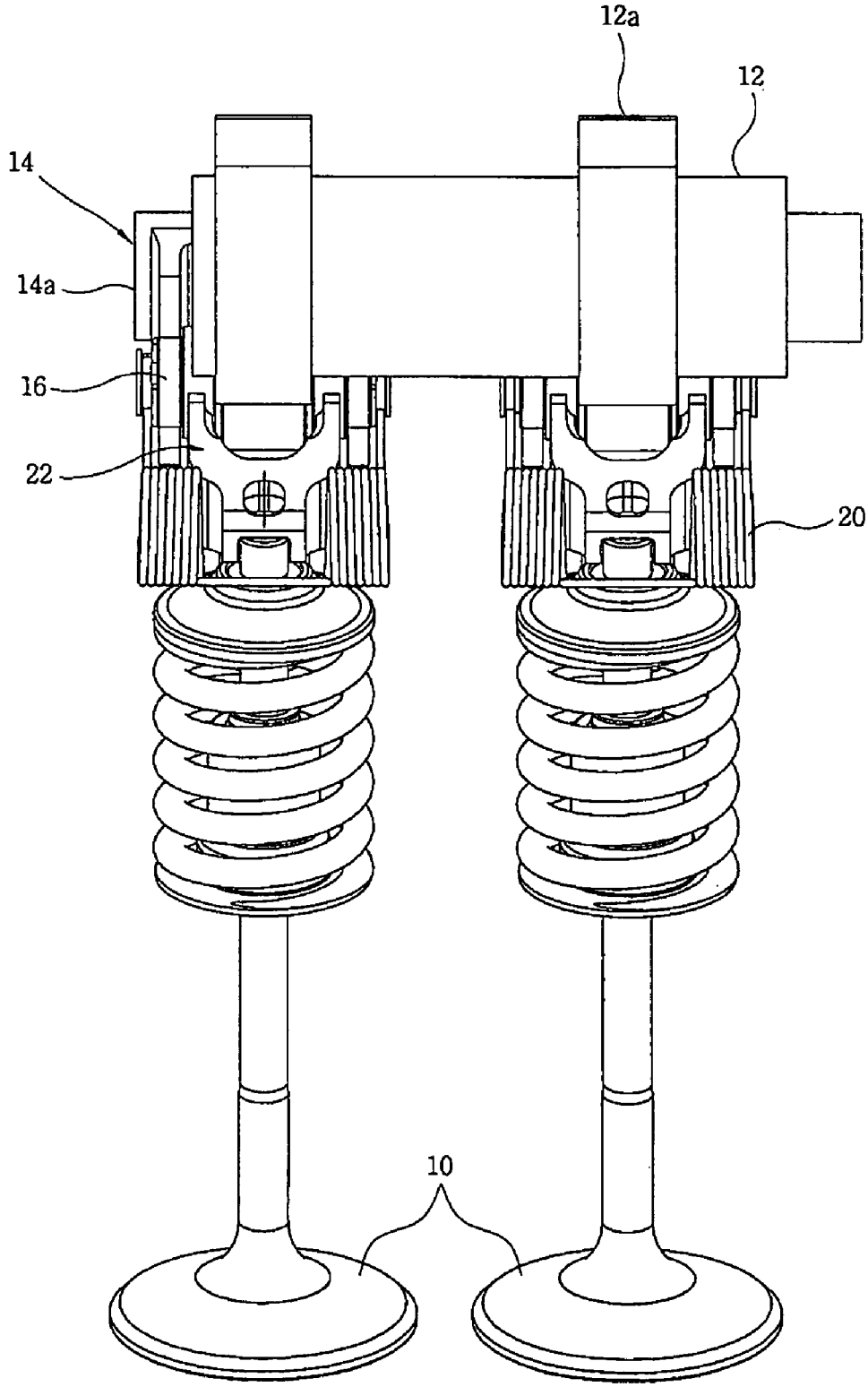
FIG. 5 is a side view of FIG. 3.

Hereinafter, an embodiment of the present invention will be described in detail with reference to the attached drawings.

As shown in FIGS. 1 through 5, a continuously variable valve lift system according to the embodiment of the present invention includes intake and exhaust valves 10 which are provided in a cylinder head of an engine, and a cam shaft 12 which is rotated in conjunction with a crank shaft and integrally has a plurality of cams 12*a* that function to open and shut the intake and exhaust valves 10. The continuously variable valve lift system further includes a rotary adjuster 14, which is disposed in the cylinder head, and a rotating angle of which is variably adjusted depending on an operational condition of the engine. First contact parts 16*a*, having predetermined curvatures, are provided at predetermined positions on the rotary adjuster 14. The continuously variable valve lift system further includes bearing members 18 which are provided in the cylinder head such that moving tracks of the bearing members 18 depend on and are varied by compression of the cams 12*a* and the first contact parts 16*a* of the rotary adjuster 14, and elastic members 20 which bring the bearing members 18 into contact with the cams 12*a* and the rotary adjuster 14. The continuously variable valve lift system further includes rocker arms 22, each of which has second contact parts 22*a* having predetermined curvatures. The second contact parts 22*a* are in contact with and are compressed by each bearing member 18, the moving track of which depends on and varies with both the profile of each cam 12*a*, provided on the cam shaft 12, and the profiles of the first contact parts 16*a* of the rotary adjuster 14.

Each of the rocker arms 22 is pivotably supported at a first end thereof by each hydraulic lash adjuster 24 and is coupled at a second end thereof to an upper end of each of the intake and exhaust valves 10 to compress the intake or exhaust valve 10.

In this embodiment, the rotation center of the rotary adjuster 14 is set such that it is not higher than the rotation center of the cam shaft 12 based on a lower surface of the cylinder head. In other words, the rotation center of the rotary adjuster 14 is the same as or is lower than the rotation center of the cam shaft 12.

Furthermore, the bearing members 18 are disposed below the cam shaft 12 and between the rotary adjuster 14 and the rocker arms 22.

Meanwhile, the rotary adjuster 14 includes a rotating shaft 14*a* which is rotatably installed in the cylinder head, and a rotating angle of which is adjusted by a step motor 26, and control cams 16 which are provided at predetermined positions on the rotating shaft 14*a* and are oriented downwards. Each control cam 16 has a first contact part 16*a* having a predetermined curvature. The rotating angle of the step motor 26 is adjusted by an electronic control unit (ECU) according to the load of the vehicle when traveling. That is, the electronic control unit adjusts the rotating angle of the step motor 26 according to the load of the vehicle when traveling, so that the valve lift and the opening duration by rotation of the cam shaft 12 are adjusted.

In this embodiment, each first contact part 16*a* integrally has a first guide surface which is convexly curved towards the associated bearing member 18, and a second guide surface which extends from the first guide surface and is concavely curved with respect to the bearing member 18.

Furthermore, each elastic member 20 comprises a torsion spring which is fastened at a first end thereof to the cylinder head and is supported at second ends thereof by each bearing member 18.

The second contact parts 22*a* of each rocker arm 22 are curved in concave shapes with respect to the bearing member 18 to effectively receive compression force transferred from the associated bearing member 18.

Figure 6:
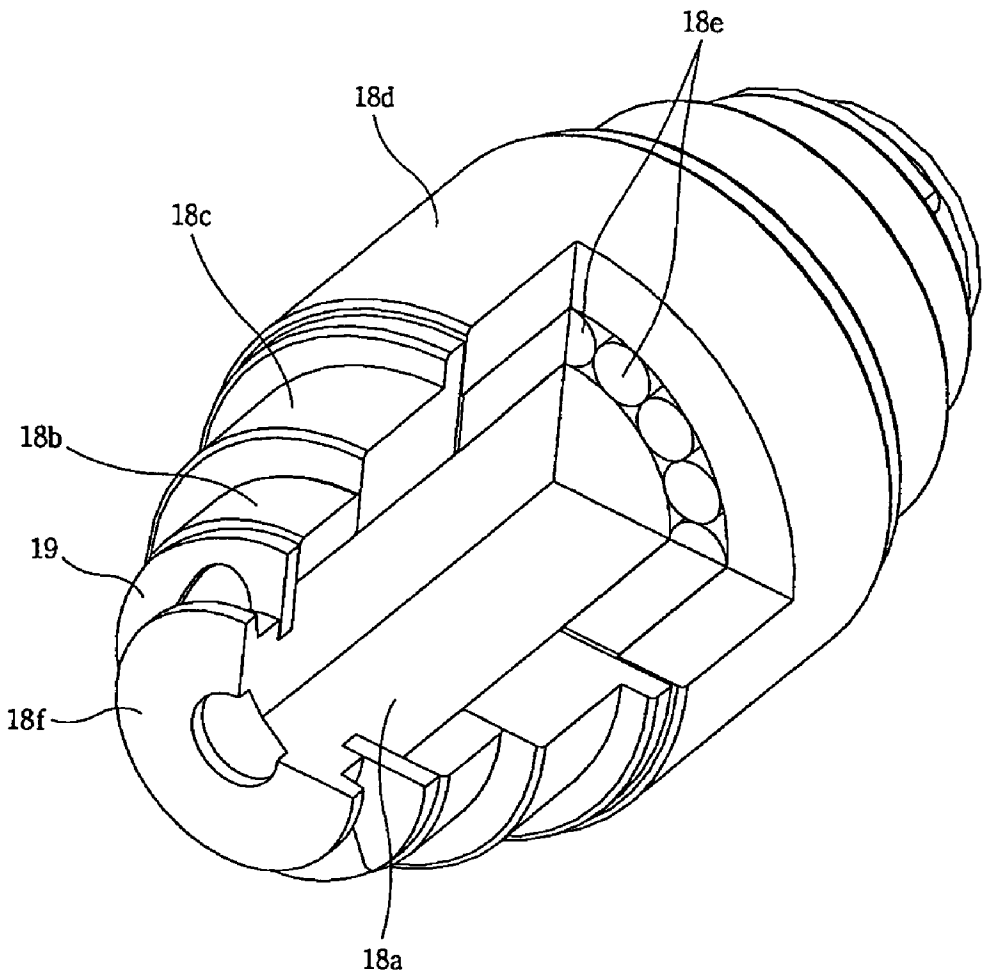
FIG. 6 is a partially broken perspective view of a bearing member of the continuously variable valve lift system of FIGS. 1 through 5.
Figure 7:
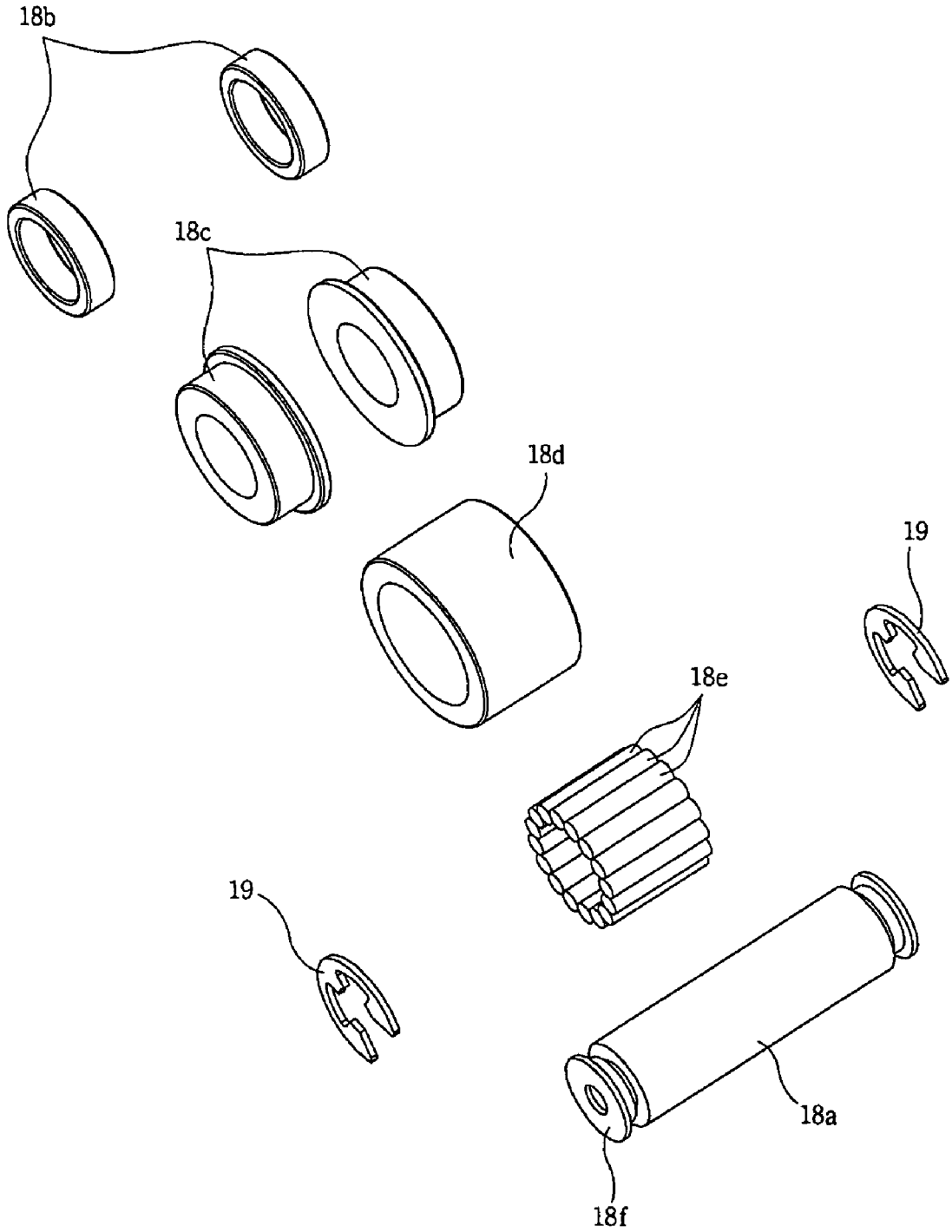
FIG. 7 is an exploded perspective view of the bearing member of FIG. 6.

As shown in FIGS. 6 and 7, each bearing member 18 includes a support shaft 18*a* which is disposed along a longitudinal center line of the bearing member 18, and first contact rings 18*b* which are rotatably fitted over a circumferential outer surface of the support shaft 18*a* such that the first contact rings 18*b* are brought into contact with the associated first contact parts 16*a* of the rotary adjuster 14. Each bearing member 18 further includes second contact rings 18*c* which are rotatably fitted over the support shaft 18*a* at positions close to inner sidewalls of the first contact rings 18*b* such that the second contact rings are brought into contact with the second contact parts 22*a* of each rocker arm 22, and a third contact ring which is rotatably fitted over the support shaft 18*a* at a position close to inner sidewalls of the second contact rings 18*c* and is in contact with each cam 12*a*.

In this embodiment, a plurality of idle rollers 18*e* is provided between the support shaft 18*a* and the third contact ring 18*d* to ensure smooth rotation of the third contact ring 18*d* with respect to the support shaft 18*a*.

Furthermore, snap rings 19 are fitted over opposite ends of the support shaft 18*a* to prevent the first contact rings 18*b* from being removed from the support shaft 18*a* in an axial direction.

As well, a stepped flange part 18*f*, a cross-section of which is enlarged moving from the inside to the outside, is integrally provided on each of the opposite ends of the support shaft 18*a*, so that each second end of the associated elastic member 20 is inserted and supported in a space defined between the stepped flange part 18*f* and the associated snap ring 19.

Figure 8:
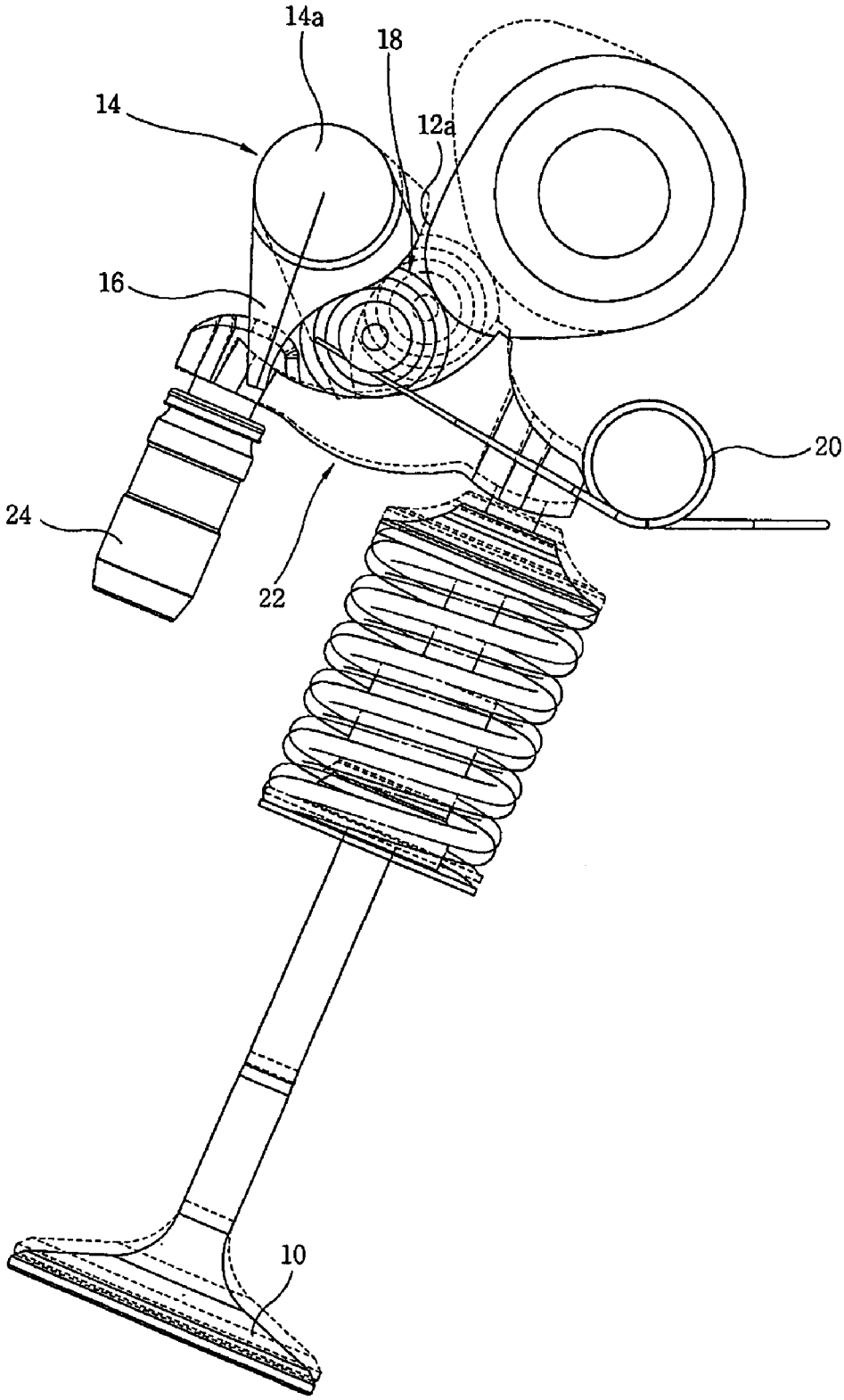
FIGS. 8 through 10 are views showing variation in valve lift during the operation of the continuously variable valve lift system according to the present invention.
Figure 9:
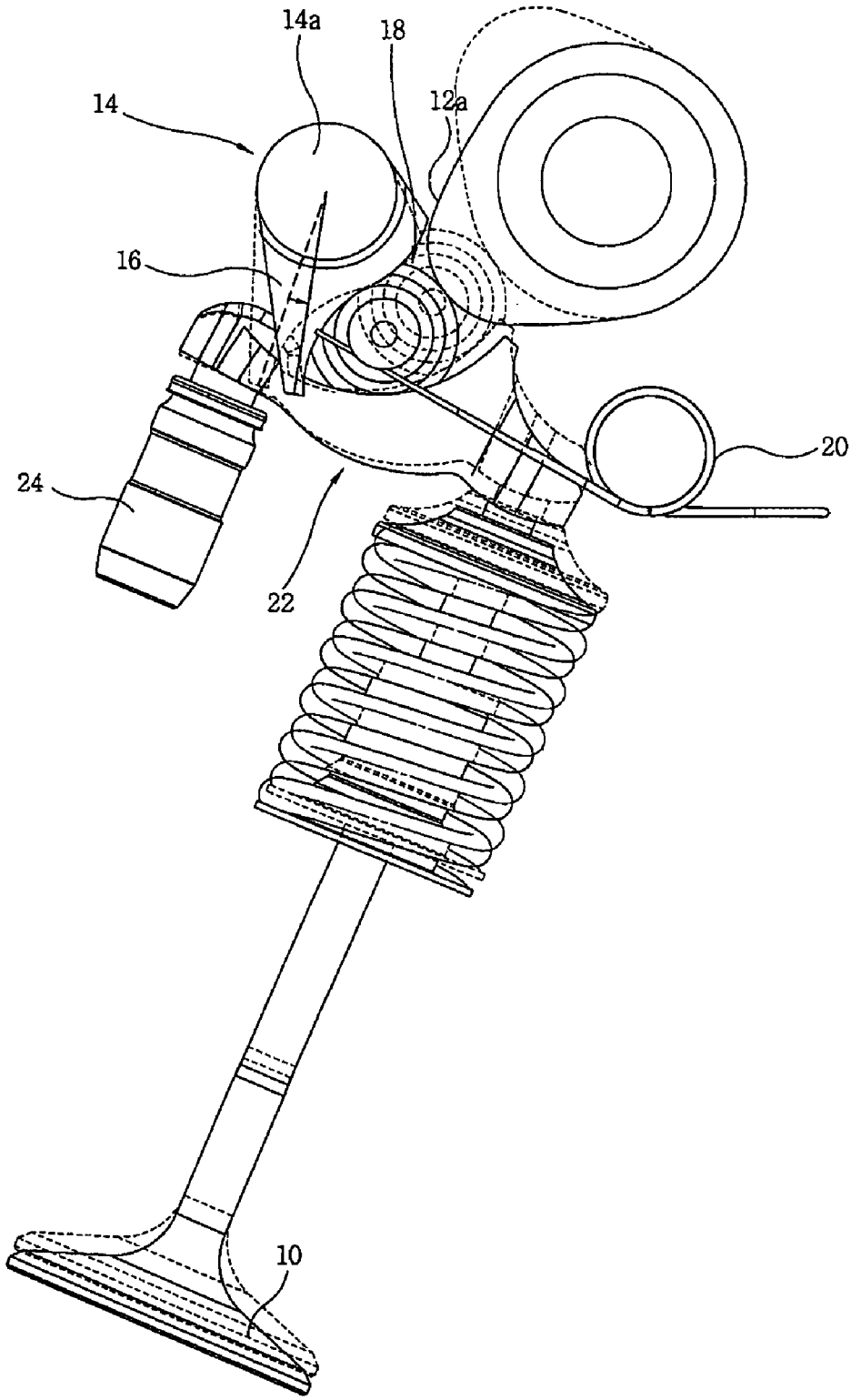
Figure 10:
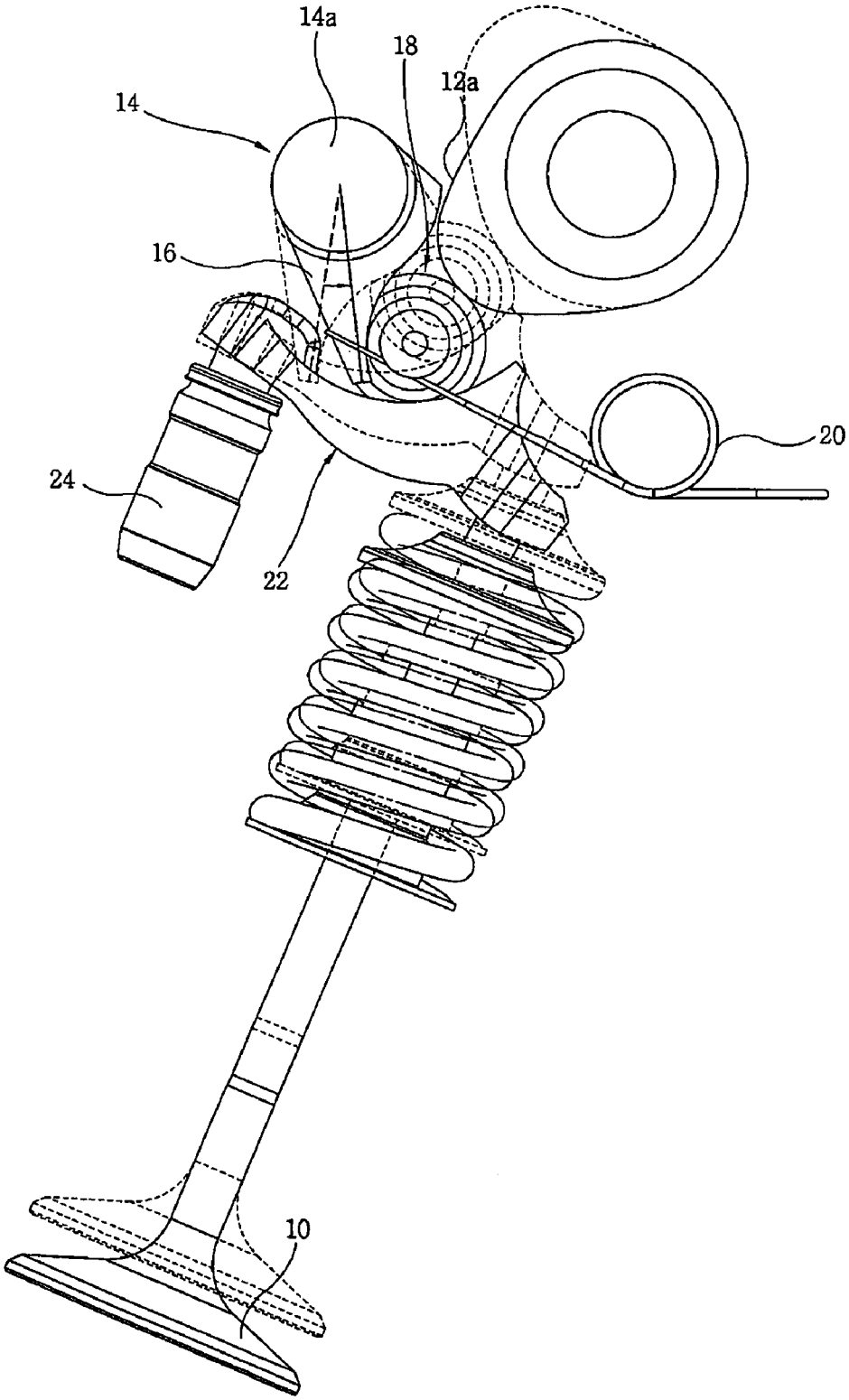

Therefore, in the continuously variable valve lift system of the present invention having the above-mentioned construction, as shown in FIGS. 8 through 10, when the step motor 26 rotates the rotating shaft 14*a* of the rotary adjuster 14 at a predetermined angle under the control of the electronic control unit, the setting angle of the first contact parts 16*a* of the control cams 16 provided on the rotary adjuster 14 varies.

The cams 12*a* are rotated by the rotation of the cam shaft 12, which contact the third contact rings 18*d* of the bearing members 18, and compress the bearing members 18. Then, the first contact rings 18*b* of the bearing members 18 are brought into contact with the first contact part 16*a* of the control cams 16 of the rotary adjuster 14, and the second contact rings 18*c* of the bearing members 18 are brought into contact with the second contact parts 22*a* of the rocker arms 22.

In this case, the valve lift and the opening duration of the intake and exhaust valves 10 depend on and vary with the profiles of the cams 12*a*, the profiles of the first contact parts

16*a* of the control cams 16 of the rotary adjuster 14 and the profiles of the second contact parts 22*a* of the rocker arms 22.

For example, as shown in FIG. 8, when the rotating angle of the rotating shaft 14*a* of the rotary adjuster 14 is at 0°, variation of valve lift and opening duration of the intake and exhaust valves 10 by the rotation of the cam shaft 12 is smallest. As shown in FIG. 9 and 10, when the rotating shaft 14*a* of the rotary adjuster 14 is rotated at 10° and 25° in a counterclockwise direction, that is, when the rotating angle of the rotating shaft 14*a* of the rotary adjuster 14 is increased, valve lift and opening duration of the intake and exhaust valves 10 are also gradually increased.

As is apparent from the foregoing, in the present invention, elements of a continuously variable valve lift system, which is provided in a cylinder head of an engine and varies the valve lift and opening duration of intake and exhaust valves, are reduced to a rotary adjuster, a bearing member and a rocker arm, thus ensuring a compact layout in a design process.

Furthermore, the reduced number of elements of the continuously variable valve lift system can reduce the weight of the system. Particularly, because the system is set such that the rotation center of a rotary adjuster is not higher than the rotation center of a cam shaft, the overall height of the cylinder head of the engine is not increased, so that the volume of the engine is reduced.

What is claimed is:

1. A continuously variable valve lift system, comprising:

a cam shaft provided in a cylinder head of an engine and rotated in conjunction with a crank shaft, with a plurality of cams provided on the cam shaft to open and shut intake and exhaust valves;

a rotary adjuster set such that a rotating angle thereof is variably adjusted depending on an operational condition of the engine, with first contact parts provided at predetermined positions on the rotary adjuster and having predetermined curvatures;

bearing members to be compressed both by the cams and by the first contact parts of the rotary adjuster, such that moving tracks of the bearing members vary dependently with the cams and the first contact parts;

elastic members to bring the bearing members into contact with the cams and the rotary adjuster; and rocker arms in contact with and compressed by the bearing members and having second contact parts having predetermined curvatures, each of the rocker arms being pivotably supported at a first end thereof by a lash adjuster and compressing at a second end thereof each of the intake and exhaust valves, wherein the rotary adjuster is set such that a rotation center thereof is level with or is lower than a rotation center of the cam shaft based on a lower surface of the cylinder head, and the bearing members are disposed below the cam shaft and between the rotary adjuster and the rocker arms, wherein each of the bearing members comprises:

a support shaft disposed along a longitudinal center line of the bearing member;

first contact rings rotatably fitted at predetermined positions over a circumferential outer surface of the support shaft, such that each of the first contact rings contacts each of the first contact parts of the rotary adjuster;

second contact rings rotatably fitted over the circumferential outer surface of the support shaft at positions close to inner sidewalls of the first contact rings, such that each of the second contact rings contacts each of the second contact parts of the rocker arms; and a third contact ring rotatably fitted over the circumferential outer surface of the support shaft at a position close to inner sidewalls of the second contact rings and being in contact with the associated cam.

2. The continuously variable valve lift system as defined in claim 1, wherein the rotary adjuster comprises: a rotating shaft set such that the rotating angle thereof is adjusted by a step motor; and a plurality of control cams provided at predetermined positions on the rotating shaft and oriented downwards, each of the control cams comprising the first contact part having the predetermined curvature, wherein a rotating angle of the step motor is adjusted by an electronic control unit (ECU) depending on a load of the vehicle when traveling.

3. The continuously variable valve lift system as defined in claim 2, wherein each of the first contact parts integrally has a first guide surface, which is convexly curved towards each bearing member, and a second guide surface, which extends from the first guide surface and is concavely curved with respect to the bearing member.

4. The continuously variable valve lift system as defined in claim 1, wherein each of the second contact parts is concavely curved with respect to each bearing member.

5. The continuously variable valve lift system as defined in claim 1, wherein each of the bearing members further comprises:

a plurality of idle rollers provided between the support shaft and the third contact ring.

6. The continuously variable valve lift system as defined in claim 1, wherein each of the bearing members further comprises:

a snap ring fitted over each of opposite ends of the support shaft to prevent each of the first contact rings from being removed from the support shaft in an axial direction.

7. The continuously variable valve lift system as defined in claim 1, wherein each of the bearing members further comprises:

a stepped flange part provided on each of the opposite ends of the support shaft and having a shape in which a cross-section thereof is enlarged moving from an inside to an outside, so that an end of each of the elastic members is inserted and supported in a space defined between the stepped flange part and the associated snap ring.

* * * * *